United States Patent [19]

Nall et al.

[11] 4,273,327

[45] Jun. 16, 1981

[54] SKI EXERCISING APPARATUS

[75] Inventors: Clive Nall, Los Gatos; Leo E. Long, Los Altos; Sterling C. Rigby, Los Altos; K. Boyd Baugh, Los Altos, all of Calif.

[73] Assignee: Major Sports Sales, Inc., Mountain View, Calif.

[21] Appl. No.: 102,120

[22] Filed: Dec. 10, 1979

[51] Int. Cl.[3] ..... A63B 69/18

[52] U.S. Cl. ..... 272/97; 272/146

[58] Field of Search ..... 272/97, 146, 138, 96, 272/134, 135, 136, 139, 142, 143, 144

[56] References Cited

U.S. PATENT DOCUMENTS

| | | | |
|---|---|---|---|
| 393,265 | 11/1888 | Rice | 272/97 |
| 1,618,273 | 2/1927 | Davidson | 272/139 |
| 1,623,670 | 4/1927 | Frankenfeld | 272/97 |
| 3,024,021 | 3/1962 | Coplin | 272/146 |
| 3,752,474 | 8/1973 | Macabet | 272/97 |
| 3,787,047 | 1/1974 | Brawn | 272/97 |
| 3,984,100 | 10/1976 | Firster | 272/146 |
| 4,074,903 | 2/1978 | Diez de Aux | 272/97 |
| 4,132,405 | 1/1979 | Asher | 272/146 |

FOREIGN PATENT DOCUMENTS

| | | | |
|---|---|---|---|
| 2503728 | 12/1978 | Fed. Rep. of Germany | 272/97 |
| 1081419 | 6/1954 | France | 272/138 |
| 2410486 | 8/1979 | France | 272/97 |

OTHER PUBLICATIONS

Sporting Goods Dealer, p. 208, Sep. 1971.

*Primary Examiner*—Richard J. Johnson
*Attorney, Agent, or Firm*—Thomas E. Schatzel

[57] ABSTRACT

An apparatus for providing exercises to enhance muscle tone and coordination especially adapted for skiing enthusiasts. The apparatus consists of a tilt swivel board upon which the user stands. The tilt swivel board is formed with a planar top surface and a substantially convex bottom surface. Elastic extensible springs are anchored at one end to the tilt swivel board and pass through a harness belt adapted to be attached about the user's waist. Handles are provided at the other end of the springs for grasping by the user while bending the knees. Thereafter, body weight shifts between the legs and arm movements similar to those during skiing cause the swivel board to tilt and rock thereby imparting body motions similar to those encountered during skiing.

7 Claims, 5 Drawing Figures

SKI EXERCISING APPARATUS

BACKGROUND OF THE INVENTION

1. Field of the Invention

The invention relates generally to physical exercise devices for human beings to maintain athletic proficiency, and more particularly to exercising devices to be used by snow skiers.

2. Description of the Prior Art

It is well known that snow skiing requires the use of certain disciplined motions and muscles upon which other athletic endeavors do not significantly rely. Snow skiing requires rapid and alternating shifts of weight between right and left feet as well as coordinated twisting and turning motions. In order to become proficient, muscular control and muscle tone in the legs, thighs, and ankles must be achieved. Professional and amateur skiers alike, because of the nature of the sport, have to travel long distances in order to obtain access to ski slopes, and once arrived, the actual amount of time spent on the slopes is small. Thus, the opportunity on the ski slopes for exercising critical maneuvers and obtaining strength in critical muscles is limited.

There have been attempts within the prior art to develop devices particularly suited to enhancing the specialized motions required for skiing and building muscle tone. U.S. Pat. No. 4,074,903 issued to Diez de Aux discloses an apparatus for simulating skiing down a slope. A slide or movie projector displays typical skiing terrain and a specially adapted platform introduces to skier to the accelerations that would be experienced when actually skiing over the terrain as projected. The cost of building the device as described by Diez de Aux is prohibitive to most amateur and probably to most professional skiers as well. The electromechanical apparatus to impart motion to the skier correlated to the projection system is both complex and costly. Moreover, the space required to practice the invention is significant and, the device is hardly portable.

U.S. Pat. No. 3,787,047 issued to Brawn discloses another device for ski training and muscular exercise. The apparatus is comprised of a flat board structure supported by three rolling bearing elements disposed in an isosceles triangle supporting the flat base from below. When the user stands upon the apparatus and unweights one foot in favor of the other, there is a tendency for the board to tip. It is this tipping motion, appropriately limited by the geometry of the board, which provides the exercise and training. The Brawn apparatus, while relatively inexpensive and portable, is limited in the motions that the apparatus can impart to the skier. That is, the platform can only tip or move in a predetermined arc defined by the location of the three rolling bearing means. Moreover, the Brawn apparatus does not exert any vertical forces or accelerations as are normally experienced traveling over undulating terrain.

Another ski exercising and training device is disclosed in U.S. Pat. Nos. 3,565,424 and 3,752,474 issued to Macabet et al. The devices disclosed in these patents are essentially constructed from both elastic and inelastic cables attached through pulleys to the user's body on the one hand and to an anchor support on the other hand. The user essentially exerts forces against his or her own body by movement of the user's arms and legs connected together through the pulley system of the apparatus which in turn is connected to an immovable anchor. Particularly adapted to skiers, Macabet et al describes an embodiment using clogs attached to the skier's feet permitting the skier or user of the apparatus to sway his or her legs in a lateral motion constrained by the cables of the system thereby providing resistance to said lateral motion. The Macabet apparatus suffers from various practical defects. For example, it must be anchored to an immovable object in order for it to be used; considerable floor space is required; and the clogs, hand pulleys and various components of the apparatus are cumbersome and relatively costly to manufacture. Moreover, with the Macabet apparatus the motions imparted to the skier are not similar to those actually encountered upon a ski slope. As the clogs suggested in the apparatus only permit lateral swaying of the user's legs, the motion is not indicative of the nearly 360° tipping and turning associated with actual skiing.

Devices generally for exercising the human body are old in the art. U.S. Pat. Nos. 650,656 and 1,618,273 issued to Raabe and Davidson, respectively, disclose exercising devices utilizing a harness arrangement attached to the user's body. While no doubt effective in stimulating cardiovascular functions, these devices are not suited to enhance the particular muscles needed for skiing. U.S. Pat. Nos. 393,265 and 1,623,670 issued to Rice and Frankenfeld, respectively, disclose a different type of exercising apparatus from the Raabe and Davidson patents. The Rice and Frankenfeld apparatuses do not attach to the human body, but rather the user stands upon the apparatus and exerts forces against it. In the Rice apparatus the platform upon which the user stands is attached to two pairs of spring bars which permit the platform to tilt when the user exerts forces upon handles attached to outriggers. In the Frankenfeld apparatus the user simply stands upon a platform and exerts forces against said platform through elastic cords. As is true with the other references discussed above, none of these devices provide a motion which effectively simulates the rocking, tipping and swivel actions required in skiing.

SUMMARY OF THE INVENTION

It is thus an object of the present invention to provide an apparatus which effectively simulates the muscular tensions encountered during skiing.

It is another object of the present invention to provide a ski exercise apparatus which is both simple to operate and inexpensive to manufacture.

It is yet another object of the present invention to provide a ski exercise apparatus which requires minimum floor space in which to operate.

It is yet another object of the present invention to provide a ski exercise apparatus which does not require attachment to an immovable object in order to function.

It is yet another object of the present invention to provide a ski exercise apparatus which is both compact, portable and lightweight.

The preferred embodiment of the present invention is constructed of several components which cooperate with one another so as to simulate actual skiing maneuvers and strengthen leg, ankle, knee, back, and arm muscles. The user stands upon a tilt swivel board, the top surface of which is planar and impressed with a non-slip texture. The underside of the tilt swivel board is formed into a gentle curvature of specific geometry so as to permit the tilt swivel board to tip and change the attitude of the top planar surface in response to the shifts in weight of the user standing upon said tilt swivel board.

Anchored about one end of the tilt swivel board are two high tension rubber shock cords. Each cord is fitted with a ski handle grip at its other end. Each rubber shock cord passes through a waist harness which is adapted to fit around the waist of the user. During operation of the ski exercise apparatus of the present invention, the user stands upon the tilt swivel board with the waist harness attached generally around the user's waist. The user bends his or her legs concurrently with stretching the rubber shock cords, thereby placing the rubber shock cords in tension and exerting a force upon the user's legs, ankles, knees, back, and arms. The position assumed by the user is analogous to that realized when skiing down a hill with a ski pole in each hand. Thereafter, as the user adjusts the weight on each foot standing upon the tilt swivel board, the attitude of the tilt swivel board changes in a continuously adjustable manner, thereby effectively simulating the range of motions encountered by a skier as the skier moves his or her feet from side to side in a complex motion pattern as down a ski slope.

It is thus an advantage of the present invention that the ski exercise apparatus effectively simulates the motion encountered during skiing while providing simple exercising for the muscles used during skiing.

It is another advantage of the present invention that the ski exercise apparatus provides a means for toning the skier's muscles, effectively eliminating soreness generally encountered during a first day of skiing.

It is another advantage of the present invention that the ski exercise apparatus may be utilized safely in one's home without requiring attachment to an immovable support or an inordinate amount of space.

It is yet another advantage of the present invention that the ski exercise apparatus may be utilized to teach children and beginners to ski.

It is a further advantage of the present invention that the ski exercise apparatus may be manufactured in high quantities for a relatively low-cost device which is lightweight, portable, and free from any maintenance requirements.

These and other objects and advantages of the present invention will become apparent after reading the following detailed description of the preferred embodiment and by reference to the drawing figures.

IN THE DRAWING

DETAILED DESCRIPTION OF THE PREFERRED EMBODIMENT

Figure 1:
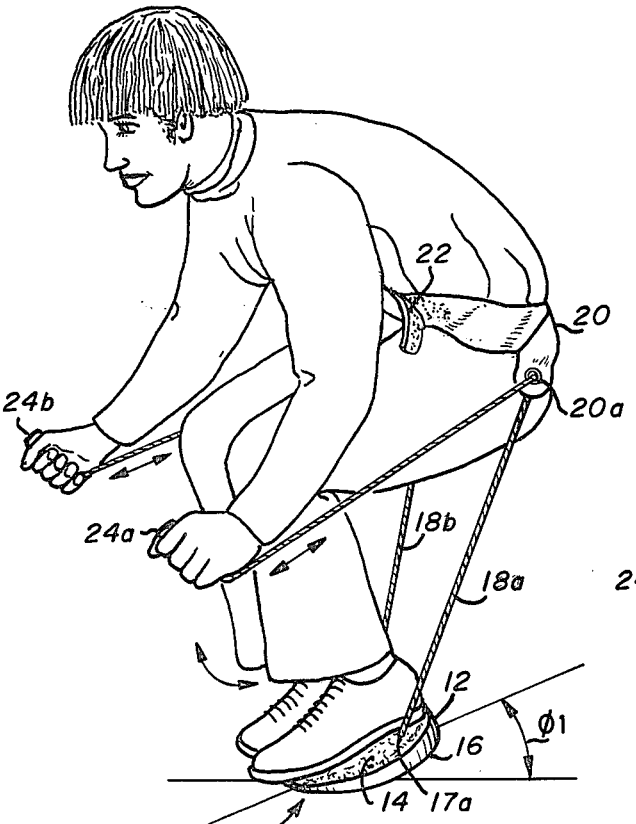
FIG. 1 is a perspective view of the apparatus of the present invention illustrating exercise by a typical user.
Figure 2:
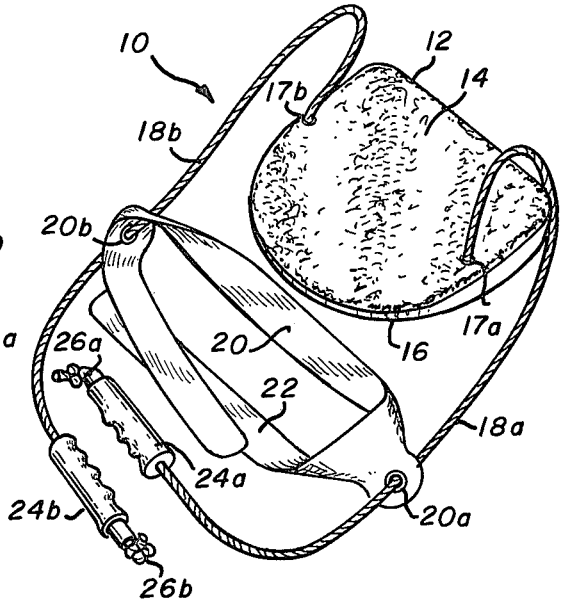
FIG. 2 is a perspective view of the apparatus of the present invention when not in use by an individual.

FIGS. 1 and 2 illustrate a ski exerciser apparatus of the present invention which is generally referred to by the numeral 10. In FIG. 1, the ski exerciser apparatus 10 is illustrated during use, showing an individual bent forward and slightly crouched. FIG. 2 illustrates the ski exerciser apparatus 10 in a resting position, i.e. not in use.

Ski exerciser apparatus 10 includes a tilt swivel board 12 which is designed to conservatively support the weight and anticipated loads of the user during exercise. Tilt swivel board 12 has a top planar surface 14 upon which the user stands. Tilt swivel board 12 has a bottom surface 16 which is formed into the shape of a gentle two-dimensional curvature in order to impart the ski-simulating motions necessary to achieve the goals of the device. The swivel board 12 provides for imparting the left and right motions, the forward and backward motions, as well as the turning motions commonly encountered in snow skiing. The shape and curvature of bottom surface 16 is described in detail below in connection with other drawing figures.

The board 12 has two anchor points 17*a* and 17*b* adjacent opposite lateral edges of the board. Attached to the top planar surface 14 at anchor points 17*a* and 17*b* are a pair of shock cords 18*a* and 18*b*, respectively. The shock cords 18*a* and 18*b* may be attached to anchor points 17*a* and 17*b* by many conventional means. For example, they may be anchored by an adhesive, a screw eye, or by the combination of a through hole through tilt swivel board 12 with shock cords 18*a* and 18*b* having an enlarged end to provide the anchor support. Shock cords 18*a* and 18*b* are constructed in the preferred embodiment from vinyl tension rubber, but said shock cords may be constructed from any elastic extensible material so as to place a pulling tension opposing the force applied by an individual when trying to elongate the cord. Shock cords 18*a* and 18*b* are each connected to a belt harness 20 by each passing through a hole 20*a* and 20*b*, respectively. As shown in FIG. 1, the belt harness 20 is adapted to fit generally around the waist or midsection of the user. Belt harness 20 has attached to it a fastening strip 22 in order to permit belt harness 20 to be snugly attached to the waist of the user. In the preferred embodiment fastening strip 22 consists of the commonly available "hook" and "eye" material, known as Velcro.

In addition, attached to shock cords 18*a* and 18*b* are handles 24*a* and 24*b*, respectively. Handles 24*a* and 24*b* slide over shock cords 18*a* and 18*b*, respectively, and are prevented from sliding off said shock cords by end knots 26*a* and 26*b*, respectively. Handles 24*a* and 24*b* are formed into a comfortable shape so that the user may grip said handles and exert an extending force upon shock cords 18*a* and 18*b* respectively.

Figure 3:
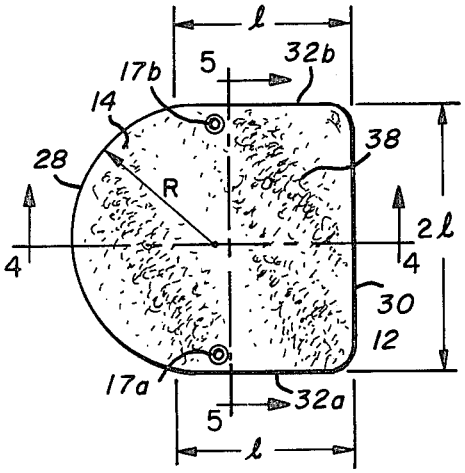
FIG. 3 is a top plan view of the tilt swivel board of the present invention.
Figure 5:
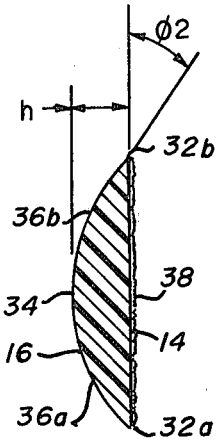
FIG. 5 is a cross-sectional view taken along line 5—5 of FIG. 3.
Figure 4:
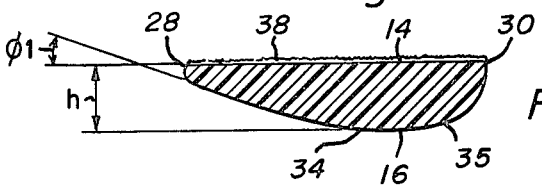
FIG. 4 is a cross-sectional view taken along line 4—4 of FIG. 3.

FIG. 3 illustrates a top plan view of the tilt swivel board 12. FIG. 4 is a cross-sectional view of board 12 taken along the line 4—4 of FIG. 3, and FIG. 5 is a cross-sectional view through the line 5—5 of FIG. 3. As can be seen from FIG. 3, the top planar surface 14 is shaped generally with a curved frontal portion 28 with a radius of curvature "R". In addition to curved frontal section 28, top planar surface has a rear edge 30 of a length "2l" and two side edges 32*a* and 32*b*, substantially perpendicular to the edges 30 of a length "l" and extending to the curved section 28. In a successful model constructed in accordance with the present invention, the radius "R" is approximately $6\frac{3}{4}$ inches, rear edge 30 is approximately $13\frac{1}{2}$ inches long and side edges 32*a* and 32*b* have the dimension of approximately $6\frac{3}{4}$ inches. The cross-sectional view of tilt swivel board 12 illustrated in FIG. 4 shows a total height "h" for the structure. In a model constructed in accordance with the present invention, the dimension "h" is approximately $3\frac{1}{2}$ inches. Bottom surface 16 as shown in FIG. 4 has an extremely gentle slope extending away from frontal edge 28 to a point 34. The slope of bottom surface 16 is approximately parallel to top planar surface 14 for the portion of bottom surface 16 extending from point 34 to a point 35 as shown in FIG. 4. The curvature of bottom surface 16 extending from point 35 to rear edge 30 is more steep than the slope from point 28 to point 34 as indicated.

FIG. 5 illustrates that the lateral curvature of bottom surface 16 of tilt swivel board 12 is symmetrical about the center point 34 and extends in a gentle curvature 36*a* and a gentle curvature 36*b* toward each lateral side 32*a* and 32*b* eventually intersecting with top planar surface 14.

The actual dimensions of the tilt swivel board 12 of the present invention are uncritical. However, it has been found that certain relative dimensions impart a more realistic skiing motion simulation. In this regard, it is desirable to generally dimension lateral edges 32*a* and 32*b* of top planar surface 14 to be one-half of the length of rear edge 30 as illustrated in FIG. 3. In addition, frontal edge 28 should be dimensioned to a radius of approximately one-half of the length of rear edge 30 as illustrated in FIG. 3. Moreover, the maximum height of convex bottom surface 16 with respect to top planar surface 14 is dimensioned to be approximately one-quarter the length of rear edge 30 as illustrated in FIG. 4. In this manner, tilt swivel board 12 experiences suitable tilting and attitude variations as a function of weight changes between the user's feet.

A model of tilt swivel board 12 made in accordance with the present invention has been constructed from wood, but it is contemplated that high production manufacture of the ski exerciser 10 will urge construction of tilt swivel board 12 from a plastic material lending itself to high volume molding techniques. In addition, FIGS. 3, 4, and 5 indicate a non-skid, non-slip surface texture 38 superimposed into top planar surface 14. A non-skid, non-slip textured surface has been applied in a model of the present invention by applying said textured surface 38 with adhesive to top planar surface 14. Such non-slip textured materials with pressure sensitive adhesive backing are commercially available. However, in high production manufacture, it is contemplated that a non-slip non-skid textured surface 38 would be superimposed directly into tilt swivel board 12 by plastic molding of said textured surface integrally therein.

Operation of the ski exercise apparatus 10 is accomplished by placing tilt swivel board 12 upon a generally flat surface. The user stands upon top planar surface 14 of tilt swivel board 12 and attaches harness belt 20 around his or her waist using fastening belt 22. Thereafter, the user grasps handles 24*a* and 24*b* and extends shock cords 18*a* and 18*b* while assuming a crouched posture as shown in FIG. 1. Stretching shock cords 18*a* and 18*b* exerts a vertical force upon the user's legs, ankles, knees, back, and arms. In such a position as shown in FIG. 1, the user is able to control the weight supported by each foot causing tilt swivel board 12 to appropriately tilt. It is possible for tilt swivel board 12 to tilt forward, e.g. at an angle $\phi_1$ as illustrated in FIGS. 1 and 4. The angle varies depending on how the user has his or her body weight distributed. The angle $\phi_1$ simulates the angle of decline of a slope. Similarly, the swivel board may be tilted laterally to either side to further illustrate a skier going down a slope at a side angle. Thus, forward and lateral movement to either side, or any combination thereof may be realized by appropriate weighting and unweighting of the user's feet. In addition, an angle $\phi_2$ as shown in FIG. 5 illustrates lateral tilting of the tilt swivel board 12. It is a combination of $\phi_1$ and $\phi_2$ tilting which imparts the full snow skiing effect.

While for the sake of clarity, and in order to disclose the invention so that the same can be readily understood, specific embodiments have been described and illustrated, it is to be understood that the present invention is not limited to the specific means disclosed. It may be embodied in other ways that will suggest themselves to persons skilled in the art. It is believed that this invention is new and that all such changes that come within the scope of the following claims are to be considered as part of this invention.

What is claimed is:

1. A ski exercise apparatus comprising:

a tilt swivel board with a top planar surface and a bottom surface of substantially convex shape;

a plurality of elastic and extensible spring members connected on the one hand to said tilt swivel board and on the other hand to means for grasping by a user while standing upon said tilt swivel board and extending said elastic and extensible spring members so as to tilt said tilt swivel board in reaction to weight changes in said user's legs; and a belt means for attachment snugly generally about the waist of the user with said elastic and extensible spring members passing through said belt means.

2. The ski exerciser apparatus of claim 1, wherein said means for grasping by a user comprises handle means attached to said tension spring members at the end of said elastic and extensible spring members opposite from said tilt swivel board and adapted to permit comfortable grasping of said handle means by said user.

3. The ski exerciser apparatus of claim 1 or 2 further comprising:

a non-skid surface superimposed upon said top planar surface of said tilt swivel board adapted to prevent said user's legs sliding off of said non-skid surface.

4. The ski exerciser apparatus of claims 1 or 2 wherein:

said substantially convex bottom surface of said tilt swivel board is symmetrical about a plane perpendicular to said top planar surface.

5. The ski exerciser apparatus of claim 7, wherein said tilt swivel board is a unitary structure.

6. The ski exerciser apparatus of claim 5, wherein:

said top planar surface of said tilt swivel board is formed with a substantially straight rear edge, substantially straight right and left lateral edges with said right and left lateral edges having a length approximately one-half of the length of said rear edge, and a circularly shaped front edge of radius approximately equal to one-half the length of said rear edge.

7. The ski exerciser apparatus of claim 6, wherein:

the height of the peak of said substantially convex bottom surface with respect to said top planar surface of said tilt swivel board is approximately equal to one-quarter the length of said rear edge of said top planar surface of said tilt swivel board.

* * * * *